US005520331A

United States Patent [19]

Wolfe

[11] Patent Number: 5,520,331

[45] Date of Patent: May 28, 1996

[54] LIQUID ATOMIZING NOZZLE

[75] Inventor: Joseph E. Wolfe, Southampton, Pa.

[73] Assignee: The United States of America as represented by the Secretary of the Navy, Washington, D.C.

[21] Appl. No.: 308,335

[22] Filed: Sep. 19, 1994

[51] Int. Cl.[6] ..... A62C 31/02; B05B 7/04

[52] U.S. Cl. ..... 239/8; 239/398; 239/434.5

[58] Field of Search ..... 239/433, 434.5, 239/8, 398; 169/14, 15

[56] References Cited

U.S. PATENT DOCUMENTS

| | | | |
|---|---|---|---|
| 894,069 | 7/1908 | Schurs | 239/434.5 |
| 1,429,415 | 9/1922 | Evans | 239/434.5 |
| 1,592,865 | 7/1926 | Moxley | 239/434.5 |
| 1,660,557 | 2/1928 | Heimburger | 239/434.5 |
| 1,986,476 | 1/1935 | Ironside | 134/167 R |
| 2,630,183 | 3/1953 | Foutz | 169/15 |
| 3,464,625 | 9/1969 | Carlsson | 239/434.5 |
| 4,103,827 | 8/1978 | Kumazawa . | |
| 4,300,723 | 11/1981 | Prasthofer . | |
| 4,378,088 | 3/1983 | Ewing . | |
| 4,603,810 | 8/1986 | Schleimer et al. . | |
| 4,690,333 | 9/1987 | Johansson | 239/434.5 |

*Primary Examiner*—Karen B. Merritt
*Attorney, Agent, or Firm*—Susan E. Verona

[57] ABSTRACT

A convergent/divergent gas nozzle atomizes a liquid provided through a liquid delivery tube having an aperture which is centered within a central gas conduit of an upstream mixing block connected to the nozzle. The aperture of the liquid delivery tube is located just upstream of a narrowed throat of the nozzle. The throat of the nozzle is dimensioned such that its inside diameter is equal to the outside diameter of the liquid injector tube. A spout is located at the discharge end of the nozzle which has an inside diameter equal to two times the inside diameter of the throat. This nozzle displays superior performance, providing an extremely fine mist having high momentum. This nozzle is particularly well-suited to fire extinguishment.

10 Claims, 1 Drawing Sheet

LIQUID ATOMIZING NOZZLE

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates to a nozzle for atomizing liquids such as water. Nozzles of this type are useful for creating a water-mist for fire extinguishment.

BACKGROUND OF THE INVENTION AND DESCRIPTION OF PRIOR ART

Nozzles employed for misting fluids with a gas are well-known. Typically, a liquid is directed into a central bore of the nozzle which directs a high-velocity gas. In some nozzles, the velocity and pressure of the gas are increased in a narrowed throat area of the bore which causes the atomization of the fluid into small droplets as the gas travels through the nozzle. To aid atomization and provide an unobstructed flow path for the gas, the fluid is usually injected into the gas stream through an aperture in the bore wall so that the two different fluid streams impinge at a 90-degree angle. Nozzles of the above-described type require high-pressure spraying of the liquid and the gas, which is undesirable. Another problem with the prior art mixing nozzles is that the liquid and gas must be sprayed through fine holes of a small diameter which can easily clog or wear away.

The use of water for a spray for fire extinguishment is well-known. Liquid-only, waterspray nozzles for fire extinguishment create water droplets by deflecting the water flow just ahead of the spouting aperture. The droplet's size is relatively large and a desirable fine water mist cannot be achieved. There is therefore a need in the art for a low-pressure, reliable liquid/gas mixing nozzle, and one which is effective for fire extinguishment.

SUMMARY OF THE INVENTION

In order to overcome the problems in the art described above, the present nozzle has been devised which provides an extremely fine, liquid atomization with low pressurization of the liquid and gas delivered to the nozzle. Furthermore, the fluid and gas are delivered through relatively large apertures so that wear and clogging are alleviated. The present invention includes a convergent/divergent (hereinafter "C-D") gas nozzle affixed to a mixing block having a liquid delivery tube with an aperture that is centered within a gas conduit and located just upstream of a narrowed throat of the nozzle.

More specifically, the present invention provides a device for mixing a liquid and a gas, comprising: a mixing block having a fluid conduit; a gas supply hose affixed to the mixing block in fluid communication with the conduit; and a liquid injector tube affixed to the mixing block and extending into the conduit, the injector tube being concentric with and parallel to the conduit. The injector tube has an aperture located downstream of the connection between the air hose and the conduit. A convergent/divergent nozzle in fluid communication with the conduit is located downstream of the liquid injector tube aperture. The nozzle has a bore with a convergent flow zone upstream of a centrally located narrowed throat area and a divergent flow zone downstream of the throat. The throat is dimensioned such that the inside diameter is equal to the outside diameter of the liquid injector tube. A spout is located at a discharge end of the nozzle, which has an inside diameter equal to two times the inside diameter of the throat. The nozzle of the present invention has smooth, tapered walls and is of circular cross-section at all points along the bore of the nozzle. The liquid may be water, provided to the injector tube under pressure from a water source, which exits the nozzle through the spout-in the form of a fine water mist.

The present method mixing a liquid and a gas comprises of the following steps: providing a supply of liquid from a source; providing a supply of gas from a source; and mixing the gas and the liquid in the mixing block and nozzle as described above.

The present nozzle displays superior performance because the momentum of the mist is increased due to the increased air speed that C-D nozzles can achieve. Atomization of water into a fine water mist is more desirable and efficient for fire protection and extinguishment because of the greater surface area and the high latent heat of vaporization of water. The mechanisms of fire extinguishment with a fine water mist are air/gas cooling, wetting of hot surfaces, the rapid expansion of steam leading to the depletion of oxygen, and smothering the flame. The very small droplet's size and high momentum created by the present nozzle can penetrate the flame faster and expand to steam more quickly. When water is mixed with air utilizing the nozzle of the present invention, it provides an extremely efficient means for delivering a very fine mist of water with high momentum. Hence, a water nozzle of this type has been shown to be particularly useful for fire extinguishment. Another suitable application is water atomization for snow-making.

It is therefore the primary object of the present invention to provide a method and apparatus which will mix and atomize a liquid and a gas spouted and dispersed at a given target or into an open space. It is another object of the present invention to provide a nozzle unit having large fluid delivery apertures and which provides complete atomization of the liquid and gas delivered at low pressure. Still another object of the present invention is to create a water-misting nozzle which provides an efficient and effective method of fire extinguishment.

Other objects, advantages and novel features of the invention will become apparent from the following detailed description of the invention when considered in conjunction with the accompanying drawings herein.

DESCRIPTION OF THE PREFERRED EMBODIMENT

Figure 1:
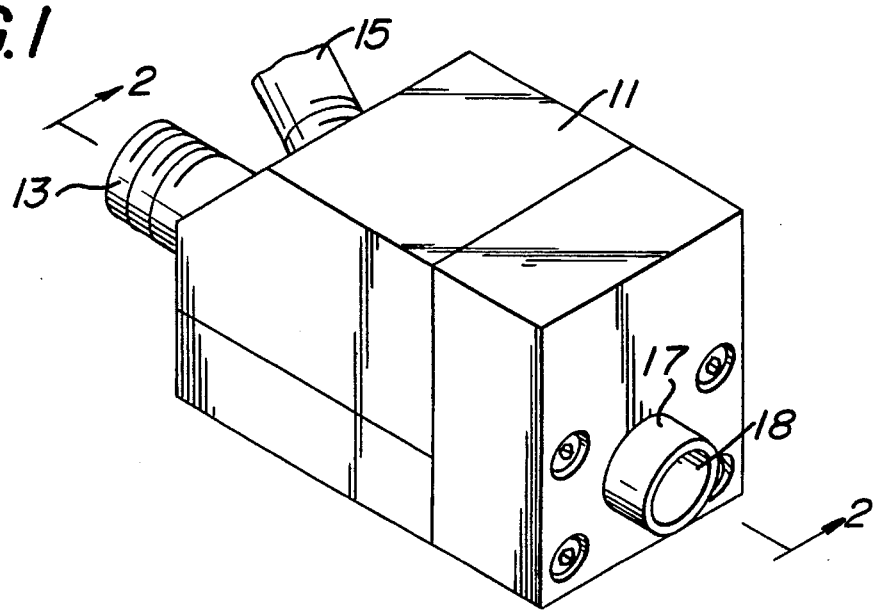
FIG. 1 is a top, right-front perspective view of the present invention.

Referring now to FIG. 1, the present invention comprises a mixing block 11 which supports and joins air delivery hose 13 and water supply hose 15. The air and water delivered through supply lines 13 and 15 respectively exit the mixing block 11 through nozzle 17 and spout 18 in the form of a fine water mist.

Figure 2:
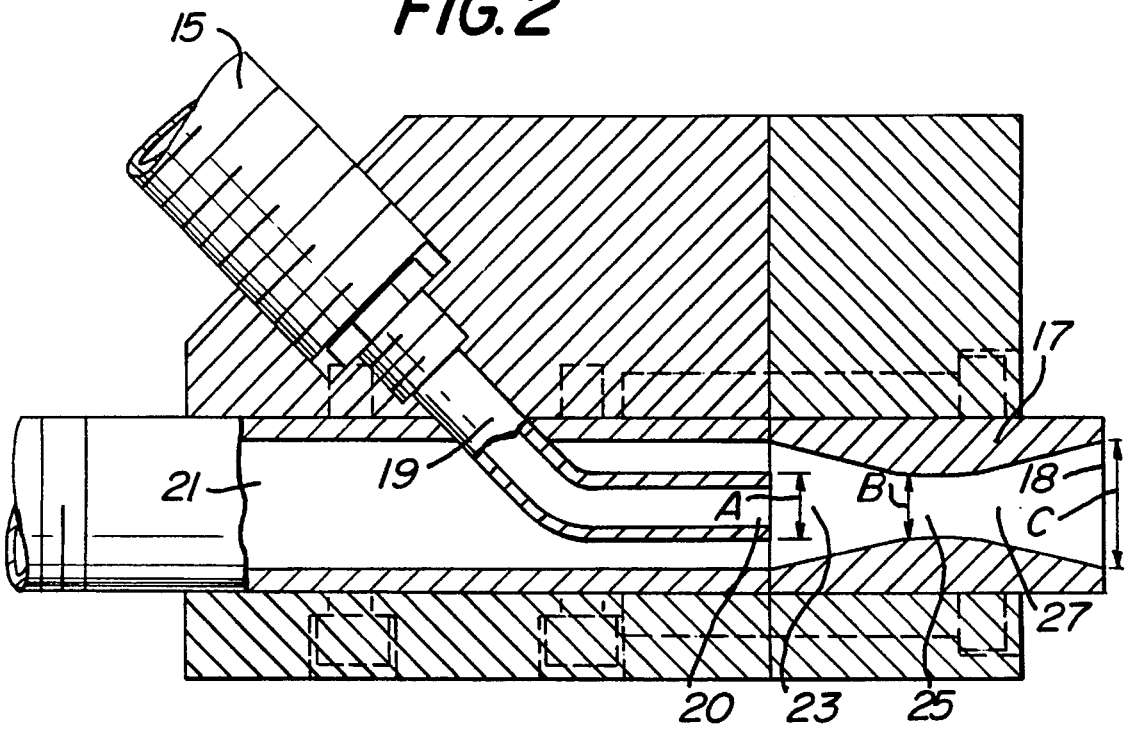
FIG. 2 is a front sectional view taken along line 2—2 of FIG. 1.

Referring now to FIG. 2, the water supply line 15 is in fluid communication with water injector tube 19 which is positioned so that its aperture 20 is concentric with and parallel to air conduit 21, both being cylindrical conduits for their respective fluids. The concentric discharge of fluids is fed directly into nozzle 17 where they are further mixed. The nozzle includes a convergent flow zone 23, a narrowed throat area 25, and a divergent flow zone 27. The air/water mixture exits the nozzle spout 18 under pressure in the form of a water mist with extremely small water droplets.

The dimensional relationships between the water injector aperture 20 and the nozzle 17 are critical to the operation of the present invention. All points along the bore of the nozzle have a circular cross-section which is concentric with both the air delivery conduit 21 and the aperture 20 of the water injector 19. It is critical that the outside diameter A of the water injector tube 19 be equal to the inside diameter B of throat 25. It is also important that the inside diameter C of spout 18 to be twice the diameter B of throat 25.

The process of air/water mixing achieved by the present invention may be described as follows. The air and water, delivered in parallel flows, mix for a short distance in the convergent zone of the C-D nozzle 17 just before the throat 25. Then the water, which is incompressible, flows through the throat section 25 with the air now highly compressed by the convergent walls of the nozzle 17. Leaving the throat 25 in the divergent zone of the C-D nozzle, the air rapidly expands and its velocity is increased. The energy from the rapid expansion of air shears the water flow into small droplets and these small droplets are accelerated to the velocity of the entrained air, thus becoming a fine water mist.

Utilizing the structures and dimensional relationships described above, a fine water mist extremely effective for a fire extinguisher can be produced. One important feature of the present invention is that the mist can be created by very low pressure delivery of both the air and the water. Typically, the air supply may be operated at 20 PSI, and the water may be supplied at 23 PSI. This is a significant operational advantage over the prior art, since low operating pressures are always preferred.

It should be understood by one of ordinary skill in the art that the mixing body as shown in the preferred embodiment, being made of individual sections, can easily be a unitary molded part. It should also be understood that different liquids and gasses, besides water and air, may be mixed with the nozzle of the present invention. For example, inert gases, such as nitrogen and carbon dioxide, may also be used.

Many modifications and variations of the present invention are possible in view of the above disclosure. Therefore to be understood, that within the scope of the appended claims, the to invention may be practiced otherwise than as specifically described.

What is claimed is:

1. A device for mixing a liquid and a gas, comprising:

a mixing block having a fluid conduit that extends therein;

a gas supply hose affixed to said mixing block in fluid communication with said fluid conduit;

a liquid injector tube affixed to said mixing block and extending into said fluid conduit, said injector tube having an aperture located downstream of the connection between said gas supply hose and said conduit, said injection tube being positioned so that the aperture of said injection tube is merged and located at about the center of said fluid conduit and so that said aperture and said fluid conduit are concentric with and parallel to each other at said merger, thereby, delivering parallel flows of respective fluids thereat;

a convergent/divergent nozzle in fluid communication with said fluid conduit located downstream of said liquid injector tube aperture, said nozzle having a bore with a convergent flow zone upstream of a centrally-located narrowed throat area and a divergent flow zone downstream of said throat area, said throat area being dimensioned such that its inside diameter is equal to the outside diameter of said liquid injection tube located at said merger; and a spout located at a discharge end of said nozzle, said spout having an inside diameter equal to two times the inside diameter of said throat.

2. The device of claim 1, wherein the nozzle has smooth, tapered walls and is of circular cross-section at all points along the bore of the nozzle.

3. The device of claim 2, wherein said liquid is water provided to said injector tube under pressure from a water source.

4. The device of claim 3, wherein said gas is delivered by said supply hose at a pressure greater than atmospheric pressure to said fluid conduit.

5. The device of claim 4, wherein said gas is air.

6. The device of claim 5, wherein said water and air exit said nozzle through said spout in the form of a fine water mist.

7. The device of claim 6, wherein the pressure of said air in said hose is approximately 20 PSI.

8. The device of claim 7, wherein said water is supplied to said mixing block through said injector tube at the pressure of approximately 23 PSI.

9. The method of mixing a liquid and a gas, comprising the steps of:

providing a supply of liquid from a source;

providing a supply of gas from a source;

mixing said gas and said liquid in a mixing block, said mixing block having a gas delivery hose that is in fluid communication with a fluid conduit that extends into said mixing block and a liquid injector tube affixed to said mixing block and extending into said fluid conduit, said injector tube having an aperture being located downstream of the connection between said gas delivery hose and said conduit;

positioning said injection tube so that the aperture of said injection tube is merged and located at about the center of said fluid conduit and so that said aperture and said fluid conduit are concentric with and parallel to each other at said merger to, thereby, deliver parallel flows of respective fluids thereat; and delivering a flow of said liquid and said gas from said mixing block to a convergent/divergent nozzle, said nozzle being in fluid communication with said fluid conduit and located downstream of said liquid injector tube aperture, said nozzle having a bore concentric with said fluid conduit, a convergent zone upstream of a centrally-located narrowed throat and a divergent zone downstream of said throat, said nozzle being dimensioned such that the inside diameter of the throat is equal to the outside diameter of said liquid injector tube located at said merger and such that a fine fluid mist is projected out of a spout of said nozzle, said spout having an inside diameter equal to twice the outside diameter of said liquid injector tube.

10. The method of claim 9, further including the step of directing said water mist at a fire for the extinguishment of said fire.

* * * * *